United States Patent [19]

Bolza-Schünemann et al.

[11] Patent Number: 4,833,984

[45] Date of Patent: May 30, 1989

[54] IMPRESSION CYLINDER SURFACE FOR PERFECTING PRESS

[75] Inventors: Hans Berhard Bolza-Schünemann; Heinrich K. Grosshauser, both of Würzburg, Fed. Rep. of Germany

[73] Assignee: Koenig & Bauer Aktiengesellschaft, Würzburg, Fed. Rep. of Germany

[21] Appl. No.: 111,418

[22] Filed: Oct. 22, 1987

[30] Foreign Application Priority Data

Oct. 25, 1986 [DE] Fed. Rep. of Germany ..... 3636359

[51] Int. Cl.[4] ..... B41F 13/18; B41F 27/12; B41F 5/06; B41F 5/24

[52] U.S. Cl. ..... 101/220; 101/415.1; 101/422; 101/475

[58] Field of Search ..... 101/415.1, 180, 407 A, 101/422; 428/908, 909

[56] References Cited

U.S. PATENT DOCUMENTS

| | | | |
|---|---|---|---|
| 13 | 9/1839 | Trench | 101/407 A |
| 312,325 | 2/1885 | Brooks | 101/415.1 |
| 350,653 | 10/1886 | Benjamin | 101/415.1 |
| 574,207 | 12/1896 | Miehle | 101/407 A |
| 1,127,680 | 2/1915 | Replogle | 101/415.1 |
| 1,140,511 | 5/1915 | Gauthier | 101/415.1 |
| 1,210,375 | 12/1916 | Decker | 428/909 |
| 1,892,623 | 12/1932 | McElroy | 101/415.1 |
| 1,999,733 | 4/1935 | Luehrs | 428/909 |
| 2,232,989 | 2/1941 | Wooddell | 428/909 |
| 2,305,852 | 12/1942 | Durham | 101/415.1 |
| 2,374,194 | 4/1945 | Grupe | 101/407 A |
| 2,712,789 | 7/1955 | Leeberg | 101/415.1 |
| 2,793,588 | 5/1957 | Stempel | 101/415.1 |
| 3,217,645 | 11/1965 | Martt | 101/415.1 |
| 3,289,578 | 12/1966 | Grosso | 101/458 |
| 3,521,560 | 7/1970 | Schmidlin | 101/145 |
| 4,559,871 | 12/1985 | Kutzner et al. . | |

FOREIGN PATENT DOCUMENTS

| | | | |
|---|---|---|---|
| 393249 | 4/1924 | Fed. Rep. of Germany | 101/415.1 |
| 3220716 | 1/1983 | Fed. Rep. of Germany | 101/415.1 |
| 3320638 | 1/1985 | Fed. Rep. of Germany . | |
| 607498 | 9/1948 | United Kingdom | 101/415.1 |
| 779035 | 7/1957 | United Kingdom | 101/415.1 |

*Primary Examiner*—Clifford D. Crowder
*Attorney, Agent, or Firm*—Jones, Tullar & Cooper

[57] ABSTRACT

A rotary printing machine has first and second printing couples for accomplishing recto and verso printing of a web. Each printing couple includes an inking unit, a plate cylinder and an impression cylinder. Each of these impression cylinders may selectively be provided with a soft or a hard cover depending on the type of printing plate secured to the plate cylinder and the type of printing ink used.

4 Claims, 2 Drawing Sheets

IMPRESSION CYLINDER SURFACE FOR PERFECTING PRESS

FIELD OF THE INVENTION

The present invention is directed generally to a printing couple with a short inking unit for a rotary printing machine. More particularly, the present invention is directed to a printing unit having two printing couples for accomplishing recto and verso printing. Most specifically, the present invention is directed to a printing couple for accomplishing recto and verso printing and having an impression cylinder which is selectively providable with a removable hard or soft cover. The removable cover allows the printing couple with the short inking unit to be used with either water based or oil based printing inks since the type of printing plate attachable to the plate cylinder can be varied due to the ability of the impression cylinder cover to be correspondingly changed. Thus either water soluble inks, which require a soft printing plate and a hard impression cylinder or oleaginous printing inks, which are used with hard printing plates and a soft impression cylinder can be used in the printing couple of the present invention.

DESCRIPTION OF THE PRIOR ART

It is generally well known that when water inks or water soluble "flexo" inks are used in printing, a soft printing plate is typically used on the plate cylinder. The use of such a soft printing plate will thus dictate the use of a hard surface on the counter pressure or impression cylinder which is cooperating with the plate cylinder that has the soft printing plate. Further, in a printing arrangement for performing recto and verso printing, the counter pressure or impression cylinder used with the plate cylinder performing the verso or second side printing of the web must have an ink-repelling surface. This is typically accomplished by using a chrome plating on the hard surfaced counter pressure or impression cylinder. This arrangement of alternating cooperating soft and hard cylinders can be characterized as a "hard-soft-hard" system. Water inks or water based inks are typically not usable in a different system having a hard printing plate and a soft counter pressure or impression cylinder due to the strong affinity of water soluble or water based inks for the rubber which is often used as the surface of the soft counter pressure or impression cylinder particularly when the printing couple is used in a verso printing operation, a layer of dried water ink will accumulate on the soft surface of the counter pressure cylinder and this build up of ink can have a substantial detrimental effect on printing quality.

In printing applications in which an oleaginous or oil soluble printing ink is being used, it is conventional to use a hard printing plate on the plate cylinder. The use of such a hard printing plate, as was alluded to above, requires the use of a soft counter pressure or impression cylinder. Even if the surface of the counter pressure cylinder has a chrome coating, there will not be an appreciable build up of oil based ink on it even though the chrome coated surface is not oil repellent. This negligible oil based ink layer build-up on the counter pressure cylinder during verso printing is negligibly small due to the generally well recognized concept of ink splitting.

The prior art printing couples, particularly those arranged for use in recto and verso printing, have not been adaptable for use with either water or oil based printing inks. This has been a result of the inflexibility caused by the surface characteristics of the counter pressure cylinder. The possible solution afforded by changing counter pressure cylinders is really not practical due to the size of these cylinders and the large amount of time that is required to remove one counter pressure cylinder and to substitute another cylinder. It will thus be seen that a need exists for a printing couple having a counter pressure cylinder whose surface characteristics can be readily and easily changed.

SUMMARY OF THE INVENTION

It is an object of the present invention to provide a printing couple with a short inking unit.

A further object of the present invention is to provide a printing couple with a short inking unit in a rotary printing machine.

Another object of the present invention is to provide a printing couple with a short inking unit in a rotary printing machine for recto and verso printing.

Yet a further object of the present invention is to provide a printing couple which can use either hard or soft printing plates.

Even yet a further object of the present invention is to provide a printing couple having a counter pressure cylinder which can selectively have a hard or soft cover.

Still a further object of the present invention is to provide a printing couple having a counter pressure cylinder adapted to receive a resilient under blanket.

As will be discussed in greater detail in the description of the preferred embodiment which is set forth subsequently, the printing unit of the present invention utilizes first and second printing couples with short inking units to accomplished recto and verso printing in a web fed rotary printing machine. Each printing couple includes a counter pressure or impression cylinder that is so structured to receive either a hard or soft surface. This may be accomplished by utilizing a soft or resilient under blanket which can be attached to the periphery of the counter pressure cylinder beneath the impression plate or cover that is used to form the surface of the counter pressure or impression cylinder.

The printing couple with a selectably hard or soft surface impression cylinder in accordance with the present invention provides a substantial amount of versatility to the rotary printing machine. Particularly when the printing machine is to be used for recto and verso printing, the use of an impression cylinder that can have either a soft or a hard surface will allow the use of either hard or soft printing plates. This can be a substantial market advantage and ca allow the printer to select whichever type of printing plate; i.e., hard or soft that is more available and hence more competitively priced. In a similar manner, the flexibility provided by the printing couple in accordance with the present invention also allows the use of either water or oil based or soluble printing inks. This again provides the printer with a better opportunity to select whichever type of printing plate and ink type that are available under favorable market conditions at any particular time.

It will thus be seen that the printing couple with a short inking unit that has a counter pressure or impression cylinder whose surface is selectably hard or soft provides a high degree of choice with respect to printing plate type and ink characteristics. This printing couple therefore is a substantial improvement over prior art devices.

BRIEF DESCRIPTION OF THE DRAWINGS

While the novel features of the printing couple in accordance with the present invention are set forth with specificity in the appended claims, a full and complete understanding of the invention may be had by referring to the detailed description of the preferred embodiment which is set forth subsequently, and as is illustrated by the accompanying drawings, in which:

DESCRIPTION OF THE PREFERRED EMBODIMENT

Figure 1:
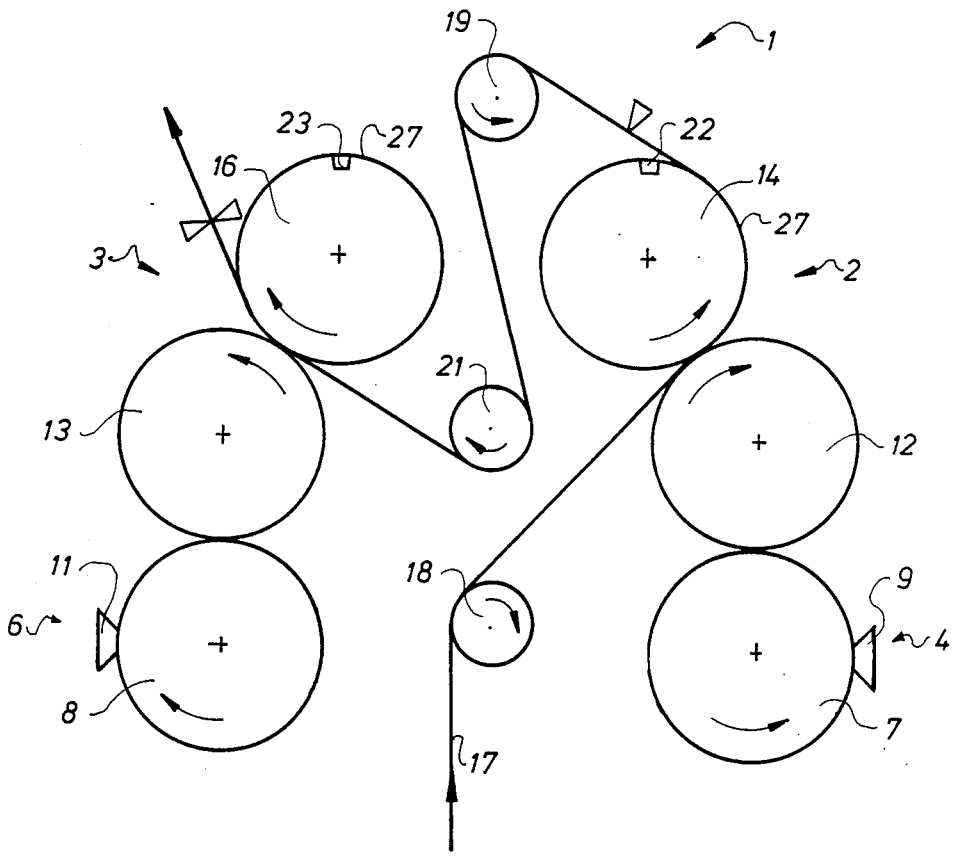
FIG. 1 is a schematic side view of a printing unit for recto and verso printing in a rotary web fed printing machine.

Referring initially to FIG. 1, there may be seen a somewhat schematic depiction of a rotary printing machine that includes a printing unit 1 which has first and second printing couples 2 and 3, respectively. These two printing couples are arranged for recto and verso printing and are positioned generally adjacent and parallel to each other. Each of the printing couples 2 and 3 has a short inking unit 4 and 6. Each of these short inking units 4 and 6 includes a screened ink roller 7 and 8, and an ink supply unit 9, and 11 respectively. These ink supply units 9 and 11 may be flush inking units of the type shown generally in German Pat. No. 3,320,638.

The screened ink rollers 7 and 8 receive ink from the ink units 9 and 11 and supply this ink to plate cylinders 12 and 13 of first and second printing couples 2 and 3, respectively. These plate cylinders 12 and 13 cooperate with impression or counter pressure cylinders 14 and 16 to print in recto and verso on a paper web 17 that is fed to first printing couple 2 and then to second printing couple 3 of printing unit 1. Paper web 17 is first diverted by a lower chrome surfaced roller 18 and is then fed into the printing gap between first plate cylinder 12 and first impression cylinder 14 so that the first side of the web 17 is printed in the recto printing operation. The web, 17, which has now been printed on a first side, is fed over a second upper chromed diverter roller 19 and under a third, intermediate chromed diverter roller 21. The paper web 17 thus is fed into a second printing gap between second plate cylinder 13 and second impression cylinder 16 in which the second side or verso printing operation is performed. Since the recto or first printed side of web 17 is in contact with the surface of the second impression cylinder 16 during the verso printing operation, it is important that particularly this second impression cylinder 16 have a surface which will not become built up with ink and thus adversely affect print quality. This fact, in combination with the requirements placed on the surface of the impression cylinder by the type of printing plate and the type of printing ink used, dictate whether the surface of each impression cylinder 14 and 16 of first and second printing couples 2 and 3 is to be either hard or soft, ink or water repellent, and oleophilic or hydrophilic.

Figure 2:
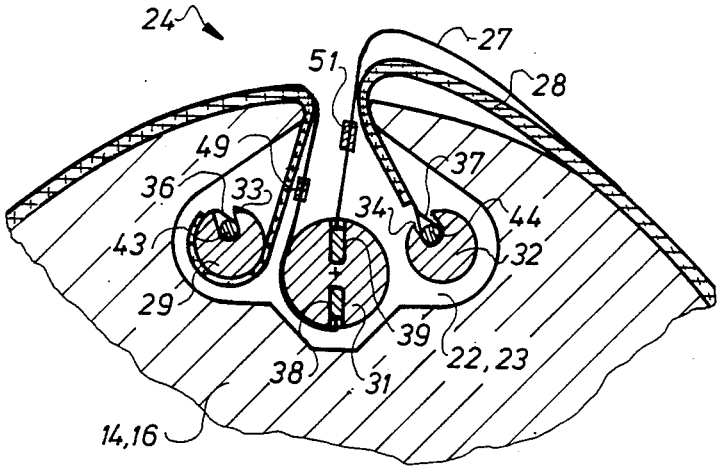
FIG. 2 is a side elevation view of a portion of an impression cylinder in accordance with the present invention and showing tensioning devices for an under blanket and an impression plate carried by the impression cylinder.
Figure 3:
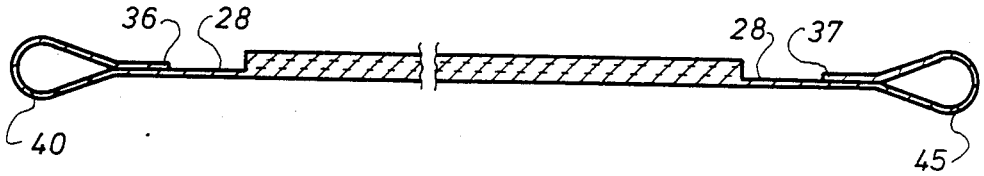
FIG. 3 is a cross-sectional view of an under blanket.

Turning now to FIG. 2, a portion of either impression cylinder 14 or 16 may be seen in detail. A groove 22 or 23 is formed in the periphery of each impression cylinder 14 or 16 and this groove is generally parallel to the rotational axis of it respective impression cylinder 14 or 16. Each peripheral groove 22 or 23 includes tensioning means, generally at 24, for use in fastening and tensioning a resilient under blanket 28 and an impression plate or cover 27 to a surface portion of either impression cylinder 14 or 16, respectively. Tensioning means, generally at 24, includes three essentially groove length tensioning shafts 29, 31, and 32. These three tensioning shafts are positioned generally parallel to each other in each groove 22 or 23 and are generally adjacent each other. The two outer tensioning shafts 29 and 32 each receive an end of under blanket 28 and each has a longitudinally extending groove 33 and 34, respectively to receive an end 36 or 37 of under blanket 28, as will be discussed in detail shortly. The central tensioning shaft 31 is used to tension the impression plate 27. This central tension shaft 31 has opposed longitudinal grooves 38 and 39 which receive first and second ends 41 and 42 of impression plate 27.

Under blanket 28 may consist of an elastic or resilient material, such as, for example, cork, linen, or a fabric of rubber and textiles. The type of material used in under blanket 28 is a function of the force of the pressing power which the impression cylinder is expected to be subjected to. The thickness of the under blanket 28 is dependent on the thickness of the impression plate 27 which is to be used with under blanket 28. The combined thicknesses of impression plate 27 and under blanket 28 should not exceed a prescribed constant thickness, such as about 3.3 mm. End portions 36 and 37 of under blanket 28 are folded back on themselves and are sewn or otherwise attached to the under blanket to form first and second holding wire receiving loops 40 and 45 whose function will be discussed in detail shortly. These loops 40 and 45 and first and second ends 36 and 37 of under blanket 28 have a thickness which is less than that of the majority of the body of under blanket 28. Since these ends 36 and 37 of the under blanket 28 are positioned within the grooves 22 or 28 in impression cylinders 14 and 16 they need not provide the resilient support that is afforded by the major body portion of each under blanket 28. Thus the under blanket 28 is designed to have its thicker major body positioned about the periphery of its respective impression cylinder 14 or 16.

Figure 4:
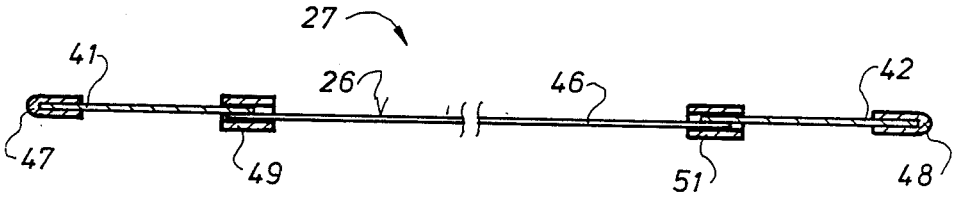
FIG. 4 is a cross-sectional view of a plate for an impression or counter pressure cylinder.

Impression plate 27 may be made of, or at least have a cover portion 27 made of a material which is either hard or soft, ink or water repellent and oleophilic or hydrophilic. This depends on the type of ink being used on the plate cylinders 12 and 18 which cooperate with impression cylinders 14 and 16. As may be seen most clearly in FIG. 4, impression plate 27 has lengths of elastic cloth, such as for example a linen material, riveted or otherwise attached at first and second end rivet or attachment positions 49 and 51. At their outer cover limits ends 41 and 42, these cloth sections of impression plate 27 are provided with first and second pinch rails 47 and 48. The length of the impression plate 27 cover portion 26 is selected so that, as may be seen in FIG. 2, when first and second pinch rails 47 and 48 are placed in the opposed grooves 38 and 39 of central tensioning shaft 31, the rivet positions 49 and 61 will be located within peripheral grooves 22 and 23 of impression cylinders 14 and 16 so that the periphery of these impression cylinders will remain smooth.

If the printing plate to be used in plate cylinders 12 and 13 is a "hard" plate; i.e., one with a Shore D hardness of approximately 90, then it is necessary that the surfaces of impression cylinders 14 and 16 be soft. In this case an impression plate or cover 27 blanket 28 which has glass bead vulcanized into it can be used on impression cylinders 14 and 16. However, if "soft" printing plates, for example ones with a Shore A hardness of 60 are to be used on plate cylinders 12 and 13 then it is necessary that the surface of impression cylinders 14 and 16 is hard and ink repellent. This is also the case when water ink is being used for the printing mechanism. Such a hard impression plate surface may be provided by using an impression plate 27 having a tri-metal cover surface 46. This tri-metal plate may have a thickness of generally about 0.3 mm and may consist of, for example, steel, copper, and chrome on its outer surface 46. This tri-metal impression plate 46 is tensioned over the under blanket 28 on impression cylinders 14 and 16 as is represented in FIG. 2. The impression plate 27 may also be made from a synthetic material or a nylon fabric.

As may be seen most clearly in FIG. 2, and as has previously been mentioned briefly, under blanket 28 may first be secured to the periphery of impression cylinders 14 and 16 by first passing holding wires 43 and 44 through first and second under blanket loops 40 and 45, respectively. These loops 40 and 45 and holding wires 43, 44, respectively are then inserted into the longitudinal grooves 33 and 34 in outer tensioning shafts 29 and 32, respectively, situated in peripheral grooves 22 and 23 of impression cylinders 14 and 16. Each such longitudinal groove 33 and 34 will be understood to include suitable means (not specifically shown) to releasably hold its respective under blanket and loop 40 or 45 and associated holding wire 43 or 44. These outer under blanket tensioning shafts 29 and 32 may then be rotated to tension under blanket 28 and may further be locked or otherwise secured in their tensioned positions.

Once under blanket 28 has been properly positioned, a first pinch rail 47 of impression plate 27 may be inserted into a first longitudinal slot 38 of central, impression plate tensioning shaft 31. This shaft may be rotated half of one turn in either a clockwise or counterclockwise direction to bring second longitudinal slot 39 into an upward facing position. The second pinch rail 48 of impression plate 27 is then inserted into this second slot 39. By additional rotation of central tensioning shaft 31 in either the clockwise or counterclockwise direction, the impression plate may be properly tensioned on the surface of impression cylinder 14 or 16. Although not specifically shown, it will be understood that central, impression plate tensioning shaft 31 will be provided with suitable locking means for holding this shaft in a locked, tensioned position.

While a preferred embodiment of a printing machine having printing couples for recto and verso printing and including impression cylinders having selectively hard or soft surface covering has been set forth in detail hereinabove, it will be apparent to one of skill in the art that a number of changes in, for example, the sizes of the cylinders, the type of inking unit used, the specific materials used for the printing plates, and the like could be made without departing from the true spirit and scope of the present invention.

What is claimed is:

1. A rotary printing machine having spaced first and second printing couples for recto and verso printing of a web, at least one of said printing couples comprising:

a printing plate cylinder, said printing plate cylinder having a soft printing plate secured to its periphery; means for supplying a water-based printing ink to said soft printing plate on said plate cylinder, said ink supply means including a screened surface ink roller; and an impression cylinder in contact with said printing plate cylinder, said impression cylinder having a resilient under blanket removably secured to its periphery and further having an ink repellent hard impression plate, which has layers of steel, copper, and chrome, removably secured to said impression cylinder over said resilient underblanket.

2. The printing couple of claim 1 wherein said impression cylinder has a peripheral groove extending generally parallel to an axis of rotation of said impression cylinder, said peripheral groove carrying spaced first and second outer tensioning shafts and a central tensioning shaft.

3. The printing couple of claim 2 wherein said under blanket has a thick major body portion and reduced thickness ends which terminate in loops, said loops being adapted receive holding wires which are receivable in longitudinal grooves in each first and second outer tensioning shafts.

4. The printing couple of claim 2 wherein said impression plate includes a central cover plate portion and flexible first and second impression plate ends, said first and second impression plate ends terminating in first and second pinch rails which are receivable in generally opposed spaced longitudinal grooves in said central tensioning shaft.

* * * * *